United States Patent [19]

Ledden, Jr.

[11] 4,078,495

[45] Mar. 14, 1978

[54] CONTROL AFTER BURNOUT FOR REACTION STEERED MISSILES

[75] Inventor: William J. Ledden, Jr., Ridgecrest, Calif.

[73] Assignee: The United States of America as represented by the Secretary of the Navy, Washington, D.C.

[21] Appl. No.: 499,233

[22] Filed: Aug. 15, 1974

[51] Int. Cl.[2] ..... F42B 13/30; C06C 25/34

[52] U.S. Cl. ..... 102/49.3; 244/3.22; 149/19.91; 149/92

[58] Field of Search ..... 102/49.3, 67; 149/19.4, 149/19.91, 92; 244/3.22

[56] References Cited

U.S. PATENT DOCUMENTS

| | | | |
|---|---|---|---|
| 2,822,755 | 2/1958 | Edwards et al. | 244/3.22 |
| 3,138,501 | 6/1964 | Wright | 149/92 |
| 3,490,373 | 1/1970 | Fox | 102/67 |
| 3,572,249 | 3/1971 | Davis | 102/67 |
| 3,756,874 | 9/1973 | Chang et al. | 149/19.4 |

*Primary Examiner*—Verlin R. Pendegrass

*Attorney, Agent, or Firm*—R. S. Sciascia; Roy Miller; L. E. K. Pohl

[57] ABSTRACT

The warhead of a missile is loaded with a payload that can either be burned or exploded. If propulsion is lost and either aerodynamic steering is not present or the velocity level of the missile is degraded to a point where steering is marginal, steerage is maintained by igniting the warhead payload and exhausting gases through nozzles attached to the warhead.

1 Claim, 2 Drawing Figures

CONTROL AFTER BURNOUT FOR REACTION STEERED MISSILES

BACKGROUND OF THE INVENTION

1. Field of the Invention

This invention relates to missiles in which steerage can be maintained after propulsion is lost.

2. Description of the Prior Art

Guided missiles are, of course, well known. A typical guided missile is made up of a warhead, a rocket motor which propels the warhead and a guidance system. The guidance system is made up of a seeker which seeks out the target and various servomechanisms which receive signals from the seeker depending upon the relative positions of the target and missile and react, depending on what signals are received, to guide the missile ever closer to the target.

In a guided missile, positive physical control of the direction in which it flies, i.e., steerage, is typically achieved by means of aerodynamic surfaces or by controlling the direction of the propulsive gases relative to the missile. Consequently, once the propelling motor burns out steerage is lost when the missile velocity degrades below a certain point in the first case and immediately upon burnout in the second case. If the missile has not come within kill distance of the target prior to loss of steerage, it will merely coast on, out of control, and finally fall harmlessly to the ground. Since a typical missile is travelling at several times the speed of sound when burn-out occurs, a typical missile will obviously coast a long way before falling to the ground. It would, accordingly, be advantageous if positive control of the missile could be maintained after rocket motor burn-out in cases where the missile has no aerodynamic surfaces and after velocity degradation where a missile does have aerodynamic surfaces in order to make use of the existing energy of the missile. That is, if steerage could be maintained the missile could be brought to within kill distance of the target even after burn-out had occurred.

SUMMARY OF THE INVENTION

According to this invention, steerage after rocket motor burn-out is maintained by providing the missile warhead with a payload which can either be exploded or burned and affixing control nozzles to the warhead. If the rocket motor burns out before the missile comes within kill distance of the target, the warhead payload is ignited and exhaust gases therefrom are exhausted through the control nozzles to maintain positive steerage. Then, when the missile comes within kill distance of the target, the remainder of the warhead payload is exploded.

DESCRIPTION OF THE PREFERRED EMBODIMENT

Figure 1:
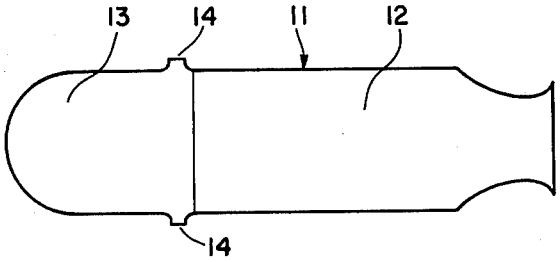
FIG. 1 is an elevational view of a missile according to this invention.

Going first to the drawing, FIG. 1 depicts, in elevation, a missile 11 made up of a rocket motor 12, a warhead 13 and a guidance system (not shown). When the missile is launched it behaves in a typical manner. That is, the burning rocket motor drives the missile, the seeker (part of the guidance system) seeks out the target and, depending on the location of the target, sends electrical signals to servomechanisms which, depending on the electrical signals received, act to control apparatus such as jet vanes which, in turn, control the direction in which the missile flies, i.e., steer the missile. Or, if aerodynamic surfaces (not shown) are present, signals from the seeker are utilized to operate them. Once the missile is brought within kill distance of the target, the warhead payload is exploded. Everything mentioned thus far is well known in the art.

A missile according to this invention differs from prior art missiles in two ways. First, the warhead payload differs from prior art warhead payload in that, in addition to being detonable, it is burnable. That is, if the missile comes within kill distance of a target while the rocket motor is still burning and maintaining positive control of the missiles direction the warhead payload is simply detonated in any well known manner. However, should burn-out and loss of steerage occur before kill proximity is reached, the warhead payload can be ignited and used as a source of hot gas. Second, auxiliary or control nozzles 14 are provided on the warhead so that, if the warhead payload is ignited, gases from the burning warhead payload can be exhausted through them to maintain control of the missiles direction.

Figure 2:
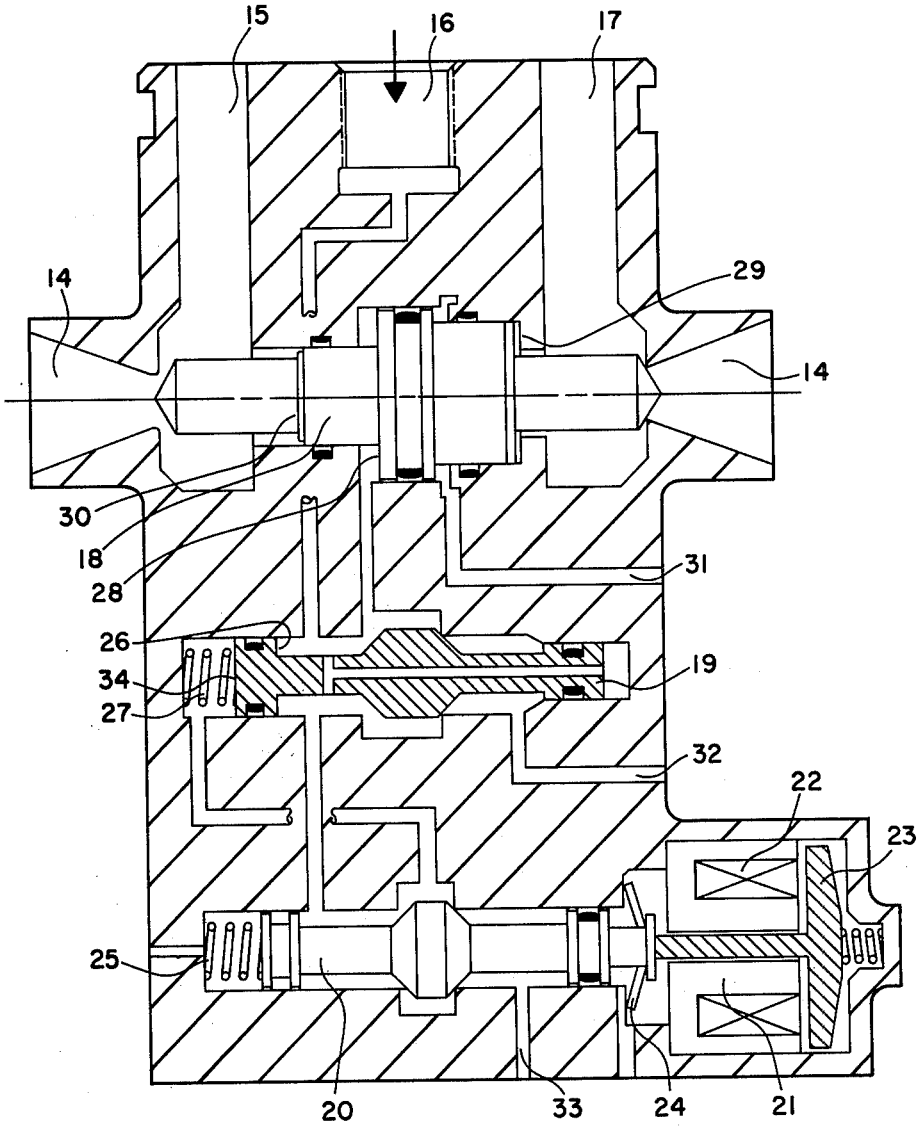
FIG. 2 is a cross-sectional view of control apparatus suitable for use in this invention.

FIG. 2 of the drawing is a cross-section through a portion of a rocket motor according to this invention showing one arrangement of apparatus which, by utilizing gases produced by a burning warhead payload, can be used to steer the missile. For purposes of this disclosure, the arrangement of apparatus shown in FIG. 2 and other arrangements of apparatus similar to that of FIG. 2 will be referred to as "after burn-out positive control apparatus". It is to be realized and should be emphasized here that FIG. 2 represents only one arrangement of apparatus where through positive control or steerage of a missile could be achieved after rocket motor burn-out.

The after burn-out positive control apparatus of FIG. 2 has two nozzles 14 (see FIG. 1 for the same nozzles). As can be readily ascertained, the after burn-out positive control apparatus is located, in a missile, just behind the warhead payload and just in front of the rocket motor. It, naturally, is connected, by means of passageways through which gas can pass, to the chamber in the warhead in which the warhead payload is located.

Three passageways 15, 16 and 17 lead from the warhead into the forward end of the after burn-out positive conrol apparatus. Gas from the burning warhead payload flows through these passageways.

Between the two nozzles 14, is a two ended pintle 18 which, as is obvious from the drawing, can close off either nozzle. (One nozzle is shown closed off in the drawing.)

Passageways 15 and 17 connect directly to the two nozzles 14. Passageway 16 encircles pintle 18, connects with a chamber around a pressure operated valve 19 and from thence continues to a chamber around a solenoid operated valve 20. The solonoid which receives signals from and is operated by the seeker (not shown) is indicated by the numeral 21. From the chamber around solonoid operated valve 20, passageway 16 continues on connecting again to the chamber around pressure operated valve 19.

As shown in the drawing, solonoid 21 is not operating. That is, the electromagnet 22 of the solonoid is not energised. Therefore, because of the arrangement of the passageways, gas from the burning warhead payload ultimately ends up exerting pressure in a way such that pintle 18 stays in the position shown, i.e., closing the nozzle shown closed.

It will readily be seen by those skilled in the art that, should electromagnet 22 become energised by a signal from the seeker, iron core 23 would be moved to overcome the forces exerted by spring washer 24 and spring 25 and the solonoid operated piston 20 would be moved to close that portion of passageway 16 leading from the chamber around the solonoid operated piston to the chamber around the pressure operated piston. This would, in turn, allow pressure on face 26 of piston 29 to overcome force exerted by spring 27 and move the piston in a way whereby gas coming through passageway 16 could no longer exert pressure on face 28 of pintle 18. This, in turn, would allow gas coming through passageway 17 to exert pressure on face 29 of pintle 18 in a way whereby pintle 18 would be moved to close the nozzle opposite of that shown closed in the drawing.

Observance of the drawing will reveal that passageways 15 and 17 are of equal size and that, with no influence from pressure obtained through passageway 16, the pintle will be moved to close the nozzle opposite of that shown closed. This is true because face 29 is larger area than face 30. It will also be noted that face 28 is larger in area than face 29 to enable the pintle to be moved into the position shown when pressure obtained through passageway 16 is in force.

Three bleed passageways 31, 32 and 33 are depicted in the drawing. Observance of the drawing will reveal that, should pressure operated valve be moved to overcome the force of spring 27 and whatever pressure is being exerted on face 34 by gas, gas will be bled away from face 28 of pintle 18. It will also be noted that if the solonoid operated valve 20 is moved to overcome pressure exerted by spring washer 24, and spring 25, gas exerting pressure on face 34 of valve 19 will be bled away. Bleed passageway 31 is to permit the relief of pressure when pintle 18 is moved into the position shown from the position not shown.

There are, known to the art, many formulations which can either be ignited and made to act as gas generators or detonated and made to act as explosives. One such formulation is a formulation made up of 86 weight percent RDX (cyclonite or trinitrotrimethylenetriamine) and 14 weight percent of a binder made up of 42 parts by weight ethylhexylacrylate, 28 parts by weight vinyl pyrrolidone, 30 parts by weight dioctylmaleate, 0.1 parts by weight triethylenglycoldimenthacrylate, and 5 parts by weight colloidal silica which has been cured by adding 0.1 parts by weight cobaltous acetylacetonate, 0.5 parts by weight t-butyl perbenzoate, 0.5 parts by weight t-butyl hydroperoxide and which may, if desired, contain an inhibitor such as p-t-butyl catechol.

The foregoing exposive formulation can be cast and cured in a warhead and, when subjected to a fuel fire, has been shown to split open a ½ inch thick bomb casing and then burn, until consumed, without detonating. On the other hand, the foregoing formulation, when subjected to the action of a warhead detonator, will explode in a high order detonation.

According to this invention, a servomechanism such as a pressure sensor is incorporated into the rocket motor chamber and attached to an igniter which, in turn, may either be embedded in or in contact with the warhead payload. The action of the pressure sensor is such that when pressure within the combustion chamber of the rocket motor subsides, as it does after the rocket propellant burns out, a switch is thrown and the igniter is activated. This starts the warhead payload burning. And, of course, gases from the burning warhead payload steer the missile by means of the above described nozzle arrangement.

According to this invention, a detonator is also provided and, when the missile comes within kill distance of the target, the detonator is activated in any well known manner. If all or any of the warhead payload is still present in the warhead it is detonated by the action of the detonator.

Neither the detonator nor the ignitor are shown in the drawing because such devices are well known in the art and because the elevational view of FIG. 1 does not lend itself to such a showing. It will, however, be obvious to those skilled in the art that the ignitor should be placed at the rear of the warhead payload and that the detonator should be as far away from the ignitor as possible. It is preferable to cast the warhead payload in a manner whereby it can be used as an end burning propellant grain should ignition become necessary.

The above described explosive formulation is particularly suitable for use in the present invention because it has an unusually high critical temperature. The temperature of a total mass of the formulation can be raised to at least 234° F without an explosion occurring.

It will be realized, by those skilled in the art, that the surface of a burning propellant (in this case the warhead payload) reaches temperatures much greater than 234° F. However, it will also be realized that heat is removed from a burning surface in a rocketry situation almost as fast as it builds up and that, no matter what the temperature of the burning surface is the temperature of the mass of a burning propellant grain remains at or near ambient.

If it is desired, activation of the ignitor can be accomplished by means of signals sent from the guidance system when deviation from course exceeds some predetermined valve rather than with a pressure switch as described above.

It would be possible to construct a missile in a way whereby gases from the burning warhead payload could be exhausted through the primary rocket motor nozzle. However, nozzles mounted on the warhead are advantageous in that they can be used to provide steerage at a much lower payload consumption rate than would be possible if the gases were exhausted through the main rocket motor nozzle.

Most of the foregoing description has been written as if the warhead payload was to be ignited immediately upon burn-out of the main rocket motor. This, of course, would not be necessary if the missile was provided with aerodynamic surfaces or some other way to maintain steerage after burn-out. Therefore, in this case it would be advantageous to utilize signals from the seeker to activate the igniter as spoken of above.

It will be noted by those skilled in the art that a warhead payload that could be either burned or detonated could be used in a weapon where the weapon was simply propelled to the general area of the target and then steered after target aquisition took place.

FIG. 2 of the drawing shows two nozzles which are to be mounted at the rear of the warhead. If it were desired, four or more could be utilized in lieu of the two shown.

What is claimed is:

1. In a missle comprising a rocket motor, a warhead, a warhead payload and primary steerage means, the improvement residing in utilizing, as the warhead payload, a composition comprising 86 weight percent cyclonite and 14 weight percent of a binder made up of 42 parts by weight ethylhexylacrylate, 28 parts by weight vinyl pyrrolidone, and 30 parts by weight dioctylmaleate.

* * * * *